US006129097A

United States Patent [19]

Papandrea

[11] Patent Number: 6,129,097

[45] Date of Patent: Oct. 10, 2000

[54] JEWELRY CLEANING DEVICE

[76] Inventor: Edward C. Papandrea, 614 Victory Cir., Boynton Beach, Fla. 33436

[21] Appl. No.: 09/412,049

[22] Filed: Oct. 4, 1999

[51] Int. Cl.[7] ..... B08B 7/04

[52] U.S. Cl. ..... 134/37; 134/104.3; 134/198; 15/268; 15/303; 15/310

[58] Field of Search ..... 134/37, 104.3, 134/198; 15/268, 303, 310

[56] References Cited

U.S. PATENT DOCUMENTS

| | | | |
|---|---|---|---|
| 483,245 | 9/1892 | Bang et al. . | |
| 1,233,431 | 7/1917 | Witt . | |
| 2,601,364 | 6/1952 | Byrnes | 134/151 |
| 3,135,987 | 6/1964 | Huch | 15/268 X |
| 4,531,246 | 7/1985 | Earley . | |
| 4,838,949 | 6/1989 | Dugrot | 134/182 X |
| 4,941,490 | 7/1990 | Gross . | |
| 4,944,051 | 7/1990 | Porter . | |
| 4,949,738 | 8/1990 | Hubbard . | |
| 5,044,387 | 9/1991 | Hsu | 134/198 |
| 5,209,784 | 5/1993 | Bellman . | |
| 5,876,513 | 3/1999 | Frankson . | |

*Primary Examiner*—Chris K. Moore
*Attorney, Agent, or Firm*—Holland & Knight LLP

[57] ABSTRACT

A jewelry cleaning device is disclosed comprising a neck portion and a body portion each formed by a wall of fine, flexible mesh material which collectively define a hollow interior having an open top in the neck portion and a closed bottom in the body portion. A support located at the open top of the neck portion is effective to mount the device to the steam pipe of a steam cleaning device so that the nozzle at the end of the steam pipe extends into the hollow interior. The body portion is formed with an access opening fitted with a closure device which is movable between an open position to permit the insert of an item of jewelry within the hollow interior, and a closed position wherein the access opening is substantially closed against the tweezers or other gripping device used to hold the jewelry item during the steam cleaning operation.

12 Claims, 4 Drawing Sheets

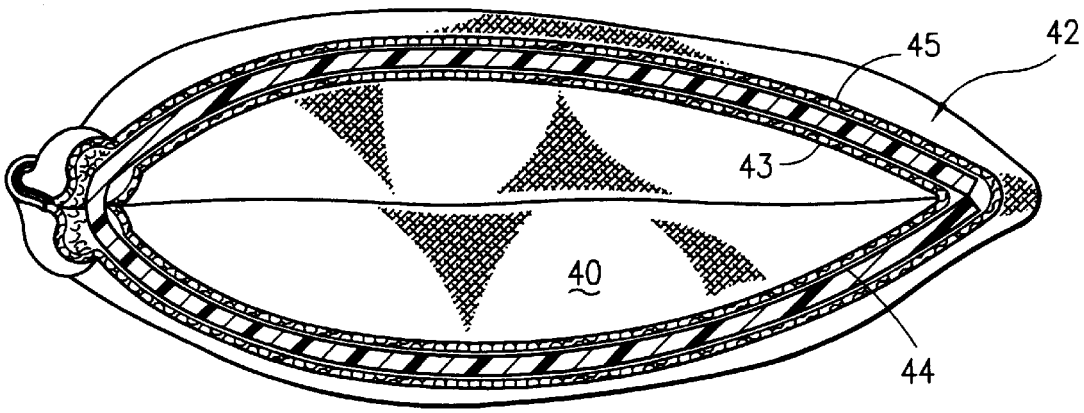
FIG. 2
FIG. 3
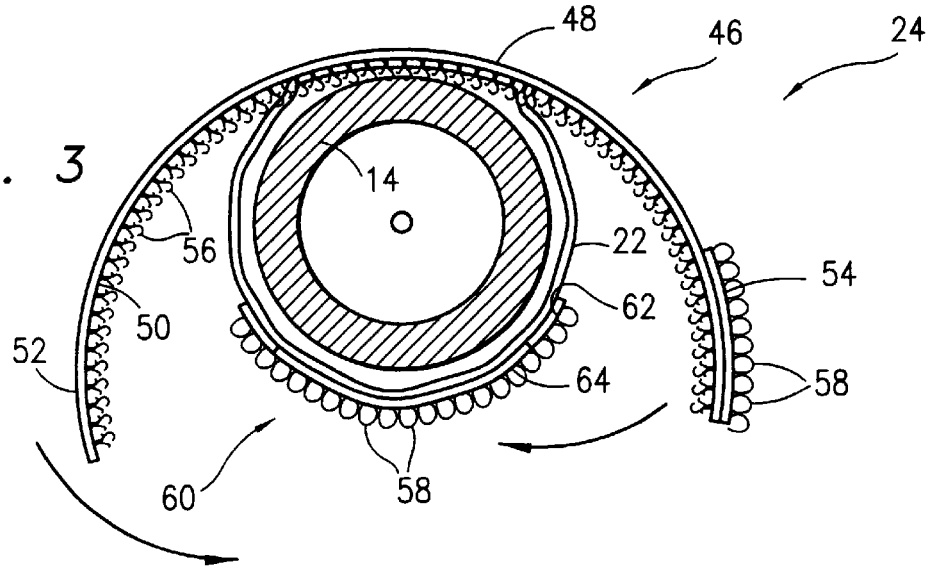
FIG. 4
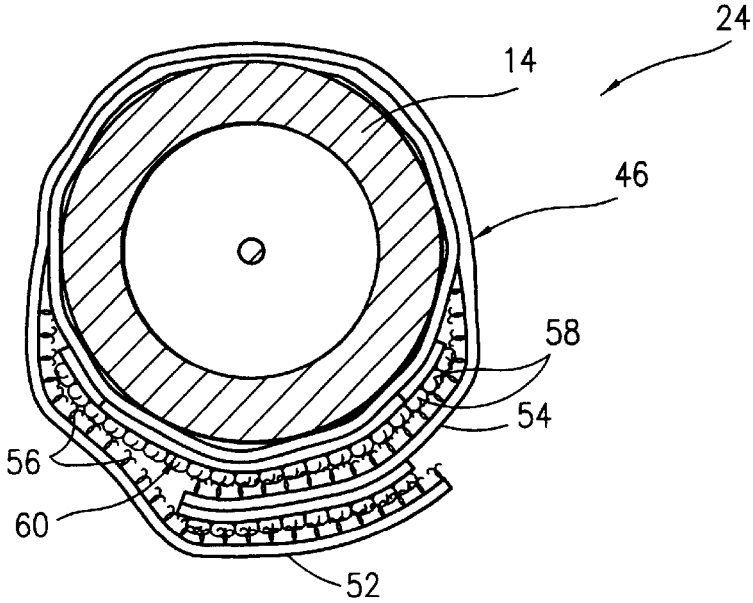

JEWELRY CLEANING DEVICE

FIELD OF THE INVENTION

This invention relates to jewelry cleaning devices, and, more particularly, to an apparatus adapted for use with a steam cleaning machine to clean items of jewelry with a jet of steam while substantially eliminating the loss of individual gem stones which may become dislodged from the piece of jewelry during the steam cleaning operation.

BACKGROUND OF THE INVENTION

Rings, bracelets, pins, necklaces, and other items of jewelry need to be periodically cleaned to maintain their appearance. Liquid cleaning solutions are effective to remove some types of dirt from items of jewelry, but hardened soap, hand lotion and the like are usually unaffected by liquid cleaners. In order to remove these types of materials from jewelry, steam cleaning machines have been employed in the jewelry industry for many years. Steam cleaning machines generally comprise a steam generating unit such as a boiler or the like connected to a pipe having a nozzle at its free end. An article of jewelry is held by tweezers directly in the path of steam emitted at relatively high velocity from the nozzle of the machine. The combination of the heat of the steam, and the force at which it impacts the item of jewelry, is effective to remove even hardened soap, hand lotion and similar contaminants from the jewelry.

Although steam cleaning machines of the type described above are effective, they suffer from a common problem. It has been found that individual gem stones in an article of jewelry can be dislodged from worn or damaged settings by the force of the jet of steam. The stones are propelled by the steam jet onto the floor, work benches, counters, equipment, shelves, open boxes etc., and can be extremely difficult to locate. Whereas very small stones can simply be replaced, large and valuable stones must be recovered no matter how long it may take the jeweler to find them.

This problem has been addressed, to some extent, in the cleaning device disclosed in U.S. Pat. No. 4,949,738 to Hubbard. The Hubbard patent teaches a jewelry cleaning device which comprises a cylindrical housing formed of clear plastic or other transparent material having an open top, an open bottom and an access opening formed between the top and bottom. The top end is closed by a top cover having an integrally mounted nozzle which attaches via threads to the steam pipe of a steam cleaning machine of the type described above. The bottom end of the housing is closed by a bottom cover which mounts a screen. An item of jewelry is inserted into the access opening in the housing in the path of steam emitted from the nozzle, and the steam exits the housing through the screen in the bottom cover. In event one or more gem stones become dislodged from the piece of jewelry during the cleaning operation, they are captured on the screen and remain within the housing.

A number of deficiencies are present in the design disclosed in the Hubbard patent. Not all steam cleaning machines necessarily employ the same sized steam pipe, and therefore the nozzle which is an integral part of the top cover of the Hubbard device may not be useful with some machines. Although different sized nozzles could be employed, this increases costs and requires such different nozzles to be maintained in inventory. The access opening in the housing of the Hubbard device cannot be opened and closed, i.e., it is always open. Consequently, gem stones which are dislodged from an item of jewelry within the housing can escape through the open access opening. Even if a dislodged gem stone remains in the housing, it is difficult to manipulate tweezers or the like through the access opening and grasp a gem stone resting on the screen at the bottom of the housing. Consequently, the bottom cover must be removed to provide access to the interior of the housing. Since the bottom cover telescopically fits over the bottom end of the housing, a stone resting on the screen of the bottom cover could be jarred off of same in the course of removing the bottom cover from the housing, particularly when the cover becomes wet with condensed steam. Finally, in the course of a cleaning operation, steam will condense on the plastic housing and can substantially reduce visibility within the housing interior. In order to completely clean an item of jewelry, it must be manipulated with respect to the fixed steam nozzle and the jeweler has to observe the position of each gem stone as it is being cleaned. If his or her vision is obstructed, the steam cleaning operation will take much longer and/or not be as effective.

SUMMARY OF THE INVENTION

It is therefore among the objectives of this invention to provide a jewelry cleaning device which is adapted for use with steam cleaning machines having steam pipes of essentially any standard size, which substantially eliminates the loss of any gem stones dislodged from an item of jewelry during a steam cleaning operation, which provides easy access to dislodged stones captured within the interior of the device, which provides good visibility during a cleaning operation and which is comparatively simple and economical to manufacture.

These objectives are accomplished in a jewelry cleaning device comprising a neck portion and a body portion each formed by a wall of fine, flexible mesh material which collectively define a hollow interior having an open top in the neck portion and a closed bottom in the body portion. A support located at the open top of the neck portion is effective to mount the device to the steam pipe of a steam cleaning device so that the nozzle at the end of the steam pipe extends into its hollow interior. The body portion is formed with an access opening fitted with a closure device which is movable between an open position to permit the insertion of an item of jewelry within the hollow interior, and a closed position wherein the access opening is closed against the tweezers or other gripping device used to hold the jewelry item during the steam cleaning operation.

In the presently preferred embodiment, the support includes a pair of tabs carried by the top end of the neck portion which mount cooperating hook and loop-fastening elements. The steam pipe and its nozzle are inserted into the interior of the cleaning device through the open top of the neck portion, and then the tabs are wrapped around the pipe and secured to one another by the hook and loop-fastening elements to secure the device onto the pipe. The closure device for the access opening in the body portion of the cleaning device is formed by overlapping first and second flaps, one of which mounts hook-fastening elements and the other loop-fastening elements. The flaps are separated from one another to receive an item of jewelry carried by a pair of tweezers, and then closed against the tweezers to substantially close the access opening in preparation for the steam cleaning operation. Additionally, a sleeve is preferably formed in the cleaning device at the juncture of the neck portion and body portion which receives a ring formed of plastic, wire or the like. The ring is effective to prevent the walls of the neck portion and body portion from clinging to themselves when impacted by a jet of steam emitted from the nozzle.

The construction of the present invention provides a number of improvements and advantages over the Hubbard device described above. Conventional steam cleaning devices are already provided with a nozzle, and may have steam pipes of different size. Unlike the Hubbard invention, the cleaning device herein does not include a nozzle and can be securely mounted to steam pipes of varying size.

An important objective of both the Hubbard design and this invention is to capture gem stones which may be dislodged from an article of jewelry during a steam cleaning operation. Nevertheless, the Hubbard device is formed with an access opening which cannot be closed. In contrast, the closure device formed by the flaps in the body portion of this invention are opened to permit insertion of an item of jewelry into the hollow interior, and then closed against the tweezers which hold the jewelry item during a steam cleaning operation. In this manner the access opening in the body portion of this invention is substantially completely closed when an item of jewelry is being impacted by a steam jet, unlike the Hubbard device which has an opening through which a dislodged stone could escape.

The mesh material which forms the walls of the neck portion and body portion of this invention provides several advantages. It is economical to purchase and can be easily sewn or glued to form the finished cleaning device. The apertures in the mesh material permit the escape of steam therethrough and thus provide good visibility into the hollow interior of the device throughout a steam cleaning operation. This avoids the problem of reduced visibility which may be experienced with the Hubbard device due to condensation of steam on the plastic wall of the housing thereof. Additionally, the flexible mesh material facilitates removal of a dislodged stone from the body portion of the device. In order to remove a dislodged stone, the jeweler can grip the stone with one hand from the outside of the body portion, open the flaps at the elongated access opening and then reach into the hollow interior with tweezers or the like to retrieve the gem stone. This substantially eliminates the possibility of losing a stone which has been captured in the body portion of the cleaning device herein, and is much easier than the method of retrieval which must be employed with the Hubbard device as described above.

DESCRIPTION OF THE DRAWINGS

The structure, operation and advantages of the presently preferred embodiment of this invention will further apparent upon consideration of the following description, taken in conjunction with the accompanying drawings, wherein:

FIG. 2 is a cross sectional view taken generally along line 2—2 of FIG. 1;

FIG. 3 is a plan view of the top end of the neck portion of the cleaning device herein, positioned around the steam pipe, in which the support is shown in an open position;

FIG. 4 is a view similar to FIG. 3 except with the support in a closed position;

DETAILED DESCRIPTION OF THE INVENTION

Figure 1:
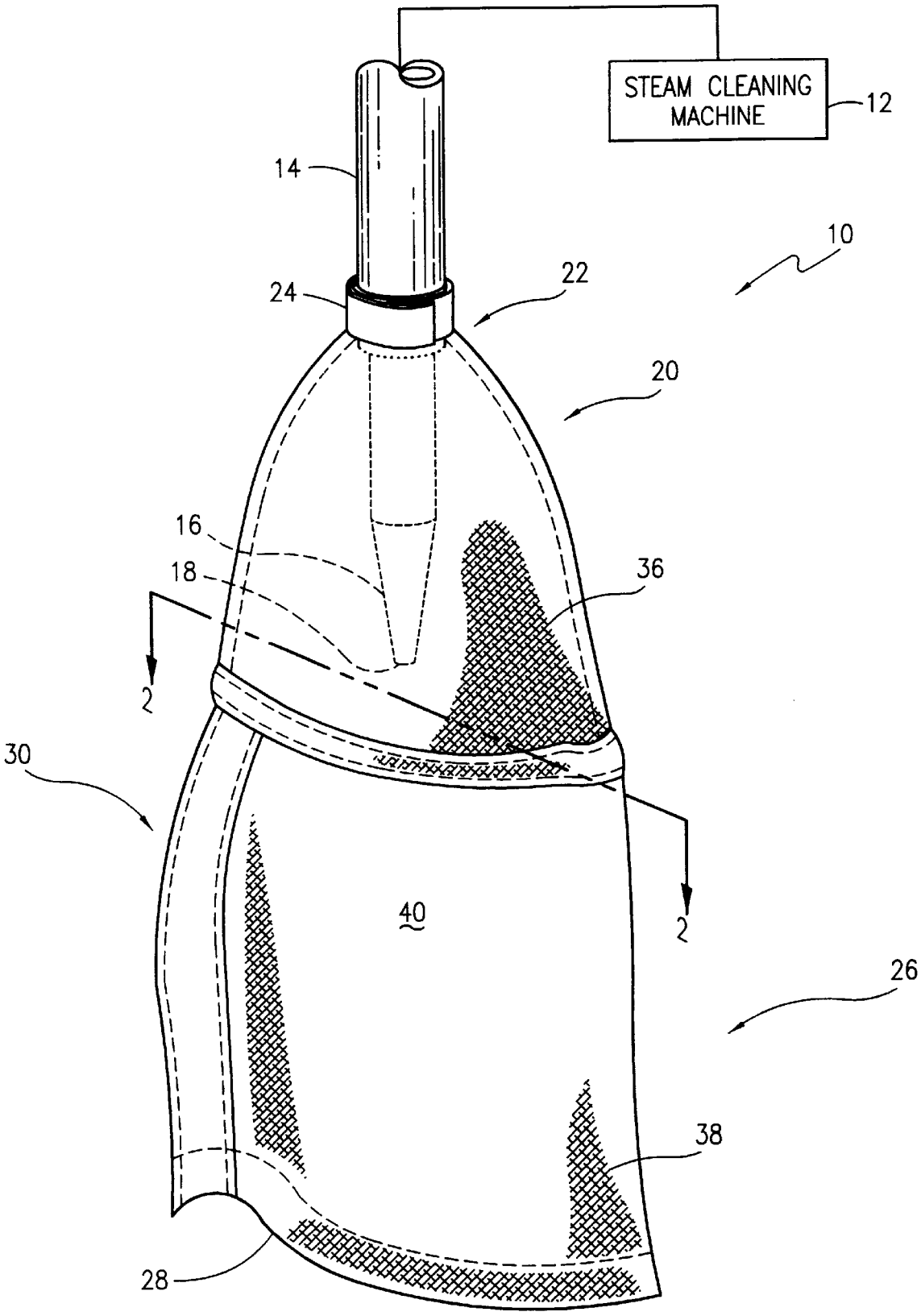
FIG. 1 is a perspective view of the cleaning device of this invention mounted to the steam pipe of a steam cleaning machine.

Referring now to the drawings, a jewelry cleaning device 10 according to this invention is adapted for use with a steam generating machine 12 having a steam pipe 14 connected to a nozzle 16. The steam machine 12 produces steam which is directed under pressure through the steam pipe 14 and emitted as a jet from the discharge outlet 18 of the nozzle 16 at a velocity and temperature which is effective to remove dirt and other foreign material from gem stones and other items of jewelry. The purpose of the jewelry cleaning device 10 of this invention is to provide an enclosure within which such jewelry cleaning operation can be conducted while insuring that any stones which may be dislodged by the force of the jet of steam emitted from the nozzle 16 are captured within the cleaning device 10 and easily recovered.

In the presently preferred embodiment, the jewelry cleaning device 10 includes a neck portion 20 having an uppermost end 22 which carries a support 24 operative to mount the jewelry device 10 to the steam pipe 14 of the steam machine 12, as described in more detail below. The jewelry cleaning device 10 also includes a body portion 26 having a closed bottom 28 and an elongated access opening 30 formed by a first flap 32 and a second flap 34 which overlap one another. See FIGS. 5A and 5B. The neck portion 20 is formed by a wall 36 and the body portion 26 is formed by a wall 38 which collectively define a hollow interior 40 of the jewelry cleaning device 10. Each of the walls 36 and 38 is formed of a fine mesh material such as nylon mesh having openings or apertures on the order of about 0.015 of an inch.

The neck portion 20 is connected to the body portion 26 at a sleeve 42, as best seen in FIGS. 1 and 2. The sleeve 42 is essentially a channel having an inner section 43 and an outer section 45 extending around the periphery of the hollow interior 40 of jewelry cleaning device 10 at the juncture of the neck and body portions 20, 26. The sleeve 42 receives a ring or spacer 44 preferably formed of plastic wire or other relatively stiff but flexible material. The purpose of the spacer 44 is to prevent the walls 36 and 38 from clinging to themselves during a steam cleaning operation as described more fully below. The mesh material forming the walls 36 and 38 is stitched, glued or otherwise permanently connected to form the neck and body portions 20, 26, the flaps 32, 34 and the sleeve 42. The details of the sewing or gluing operation form no part of this invention, and are therefore not discussed in detail.

As noted above, the jewelry cleaning device 10 of this invention is mounted to the steam pipe 14 of a steam generating machine 12 by a support 24 located at the uppermost 22 of neck portion 20. As best seen in FIGS. 3 and 4, the support 24 comprises an elongated first tab 46 having an outside surface 48, an inside surface 50, a first end 52, and a second end 54. The inside surface 50 of first tab 46 is provided with hook-fastening elements 56, and a portion of the outside surface 48 at the second end 54 is provided with loop-fastening elements 58. The inside surface 50 of first tab 46 is affixed by sewing or the like to one side of the uppermost end 22 of neck portion 20. A second tab 60 is also provided having an inside surface 62, and an outside surface 64 which carries loop-fastening elements 58. The inside surface 62 of second strip 60 is connected by stitching or the like to the uppermost end 22 of neck portion 20 at a location opposite the area where the first tab 46 is mounted.

As shown in FIG. 3, the uppermost end 22 of neck portion 20 is initially slid over the nozzle 16 and a portion of the steam pipe 14 of steam machine 12 with the first and second tabs 46 and 60 in an open or unlocked position. The uppermost end 22 of neck portion 20 loosely fits about the steam pipe 14 in the open position of support 24. In order to "close" the support 24 about the steam pipe 14, the second end 54 of first tab 46 is initially wrapped around the second strip 60 so that the hook-fastening elements 56 on the inside surface 50 of first tab 46 engage the loop-fastening elements 58 and the outside surface 64 of second tab 60. Following that, the first end 52 of first tab 46 is wrapped around the second end 54 thereof so that the hook-fastening elements 56 on the inside surface 50 of first tab 46 engage the loop-fastening elements 58 on the outside surface 48 of the second end 54 of first tab 46. See FIG. 4. In this fashion, the neck portion 20 of jewelry cleaning device 20 is securely and removably mounted to the steam pipe 14 in preparation for a steam cleaning operation. Preferably, as depicted in FIG. 1, the nozzle 16 at the end of steam pipe 14 extends into the hollow interior 40 of the jewelry cleaning device 10 to a location in the vicinity of the sleeve 42, i.e., at the juncture of the neck portion 20 and body portion 26 of jewelry cleaning device 10. At this location, the spacer 44 carried in the sleeve 42 ensures that the wall 36 of neck portion 20 and the wall 38 of body portion 26 do not cling to themselves when impacted with steam emitted from the nozzle 16.

Figure 5A:
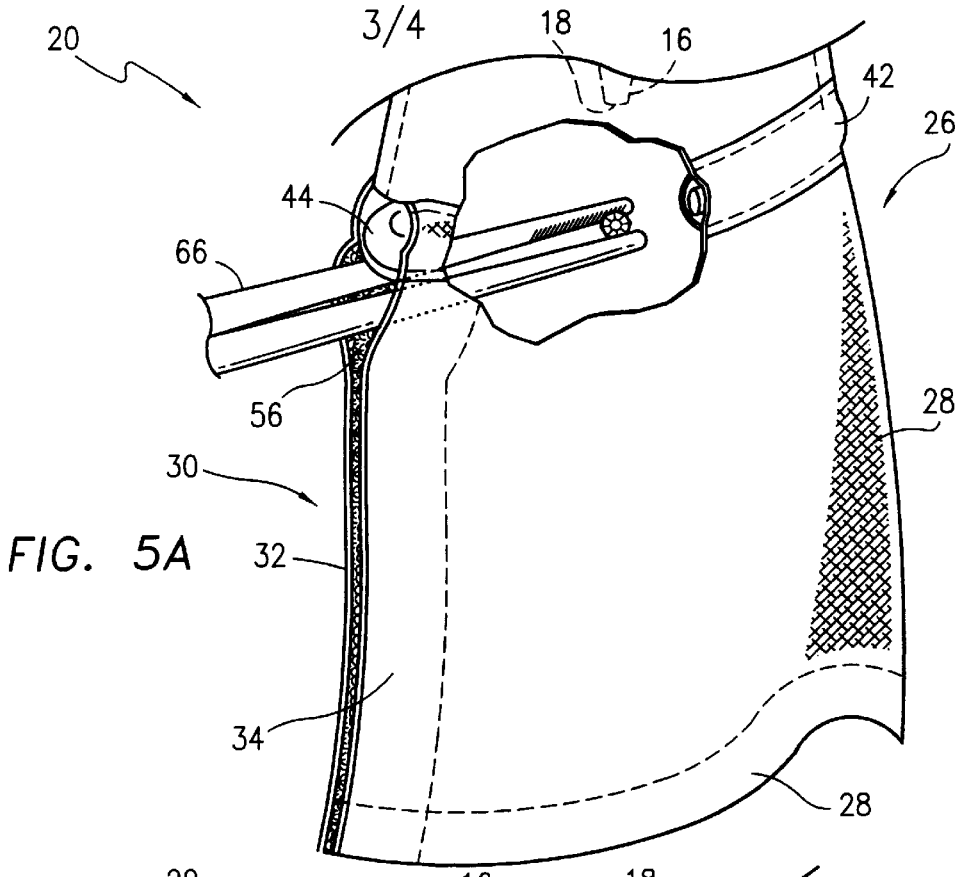
FIG. 5A is a view of the elongated access opening in the body portion of this invention, with its closure device in a closed position.
Figure 5B:
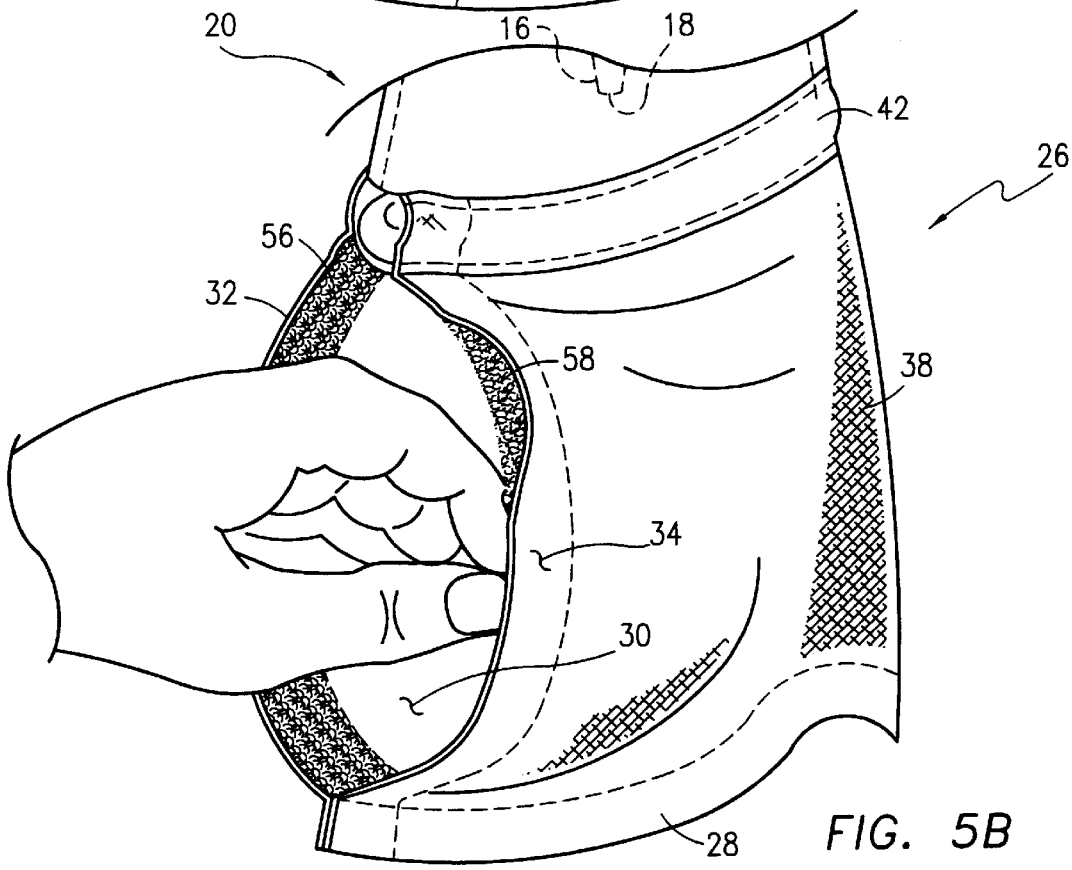
FIG. 5B is a view similar to FIG. 5A, except with the closure device shown in an open position.

With the jewelry cleaning device 10 in position on the steam pipe 14, a cleaning operation can proceed. As shown in FIGS. 5A and 5B, the first flap 32 of body portion 26 is provided with hook-fastening elements 56, while the second flap 34 is provided with loop-fastening elements 58. As such, the first and second flaps 32, 34 permit opening and closing of the access opening 30 in body portion 26 along substantially the entire length of the body portion 26. In order to perform a jewelry cleaning operation, the first and second flaps 32, 34 are separated from one another to open the upper portion of the access opening 30 adjacent to the sleeve 42. This permits the insertion of a pair of tweezers 66 carrying a gem stone 68 into the hollow interior 40 at a location immediately beneath the discharge outlet 18 of the nozzle 16. Once the gem stone 68 is in place as depicted in FIG. 5A, the first and second flaps 32, 34 are closed upon one another and against or in contact with the tweezers 66 and gem stone 68. This substantially closes the access opening 30 while permitting the tweezers 66 to be manipulated under the jet of steam emitted from the nozzle 16. The mesh material which forms the walls 36, 38 of the jewelry cleaning device 10 permits the passage of steam therethrough during a cleaning operation. Moreover, the spacer 44 prevents the walls 36, 38 from clinging to themselves. Consequently, the jeweler has good visibility within the hollow interior 40 of jewelry cleaning device 10 as the steam cleaning progresses.

As described above, it has been found that during steam cleaning operations, gem stones can become dislodged from defective or worn settings in items of jewelry and/or dislodged from the tweezers 66. The jewelry cleaning device 10 of this invention prevents the escape of such dislodged gem stones by providing a closed interior 40 within which the cleaning operation is conducted. Any dislodged stones are captured within the body portion 26 of jewelry cleaning device 10 and retained therein by the mesh wall 38 of body portion 26. In order to retrieve a dislodged gem stone 68, the steam machine 12 is turned off and the first and second flaps 32, 34 are separated from one another to open the access opening 30. This allows the jeweler to insert his/her hand into the hollow interior 40 to retrieve the gem stone 68 therein. The retrieval operation can be facilitated by grasping the gem stones with the other hand of the jeweler, i.e., from the outside of the wall 38 of body portion 26, and then retrieving the stone once the access opening 30 has been opened.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

Figure 6:
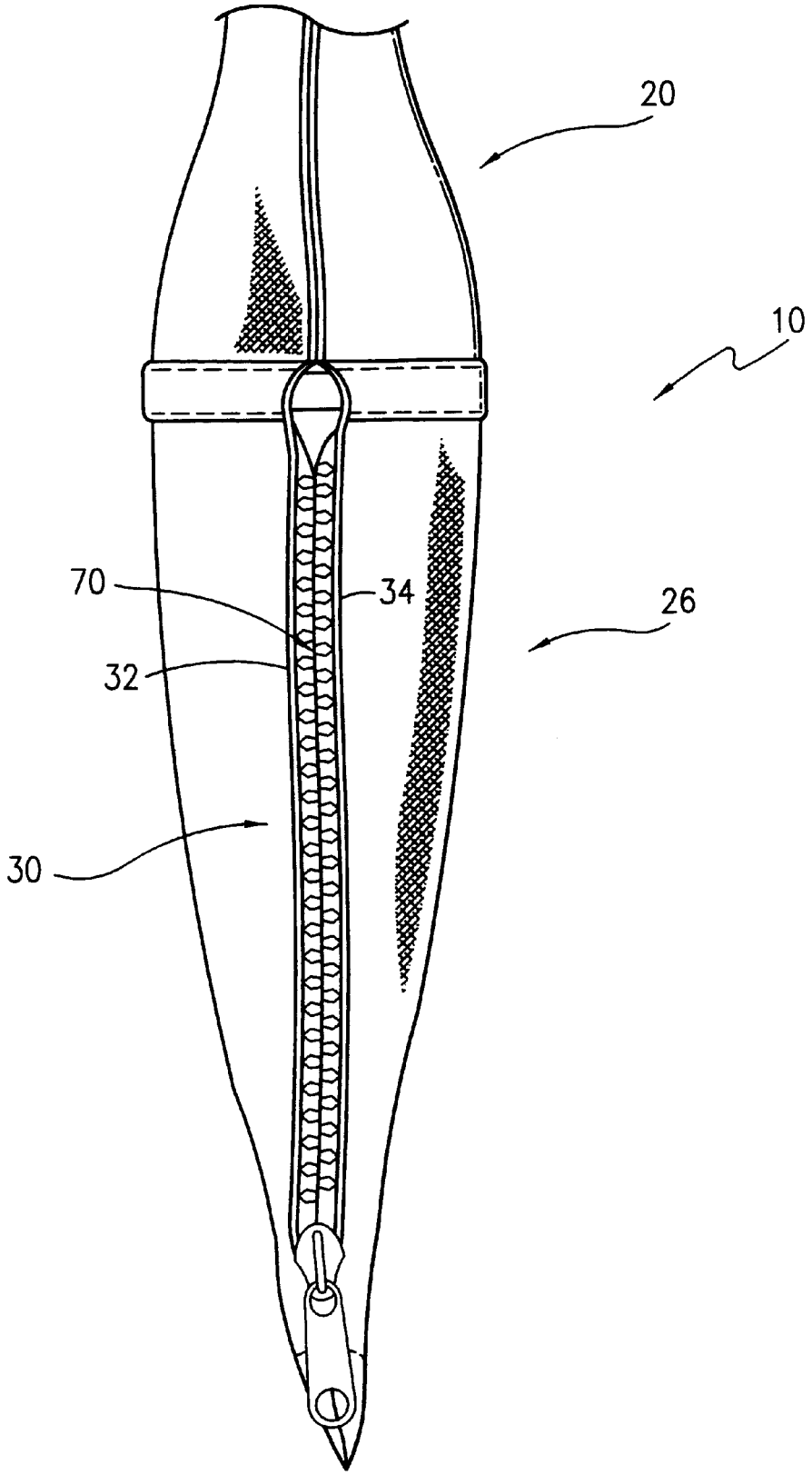
FIG. 6 is a view of an alternative embodiment of a closure device for the elongated access opening in the body portion of this invention.

For example, while the first and second flaps 32, 34 are depicted with hook and loop-fastening elements 56, 58 in FIGS. 5A and 5B, it is contemplated that the flaps 32, 34 could be opened and closed by a zipper 70 as schematically shown in FIG. 6. Other closure devices such as snaps and the like could be utilized so long as the access opening 30 can be substantially closed against the tweezers 66 during a cleaning operation, and then open to retrieve a dislodged stone if that occurs.

Therefore, it is intended that the invention not be limited to the particular embodiment disclosed as the best mode contemplated for carrying out this invention, but that the invention will include all embodiments falling within the scope of the appended claims.

What is claimed is:

1. Apparatus for cleaning items of jewelry using a steam cleaning device having a nozzle, comprising:

a neck portion connected to a body portion, said neck portion and said body portion each including a wall which collectively define a hollow interior having an open top in said neck portion and closed bottom in said body portion;

said wall of said body portion being formed with an access opening including a closure which can be opened to permit entry of an item of jewelry through said access opening into said hollow interior and then substantially closed during a cleaning operation, said wall of said body portion being formed of a mesh material through which steam can pass;

a support located at said open top of said neck portion for mounting said neck portion and body portion to a steam cleaning device so that the nozzle of the steam cleaning device extends through said open top into said hollow interior.

2. The apparatus of claim 1 in which said wall of said neck portion is formed of a mesh material.

3. The apparatus of claim 1 in which said closure for said access opening in said wall of said body portion includes a first flap and an overlapping second flap, said closure including hook-fastening elements mounted on said first flap and loop-fastening elements mounted on said second flap.

4. The apparatus of claim 1 in which said closure for said access opening in said body portion is a zipper.

5. The apparatus of claim 1 in which said support comprises:

a first tab connected to a first section of said wall of said neck portion adjacent said open top of said hollow interior, said first tab having opposed ends, an inside surface which mounts hook-fastening elements and an outside surface which mounts loop-fastening elements;

a second strip having an inside surface connected to a second section of said wall of said neck portion opposite said first section, and an outside surface which mounts loop-fastening elements;

said neck portion being mounted to a pipe of the steam cleaning machine inserted with said open top of said hollow interior by attaching said hook elements on said inside surface at one end of said first tab to said loop elements carried on said second tab, and by attaching said hook elements on the inside surface of the other end of said first tab to said loop elements on the outside surface of said first tab.

6. Apparatus for cleaning items of jewelry using a steam cleaning device having a nozzle, comprising:

a neck portion connected to a body portion, said neck portion and said body portion each including a wall which collectively define a hollow interior having an open top in said neck portion and closed bottom in said body portion;

said wall of said body portion being formed with an access opening including a closure which can be opened to permit entry of an item of jewelry through said access opening into said hollow interior and then substantially closed during a cleaning operation, said wall of said body portion being formed of a mesh material through which steam can pass;

a spacer located at the juncture of said neck portion and said body portion, said spacer being effective to substantially prevent contact of said wall of said body portion with itself in the area of said juncture with said neck portion in response to impact with steam during a cleaning operation;

a support located at said open top of said neck portion for mounting said neck portion and body portion to a steam cleaning device so that the nozzle of the steam cleaning machine extends through said open top into said hollow interior.

7. The apparatus of claim 6 in which a sleeve is formed at the juncture of said neck portion and said body portion, said spacer comprising a ring insertable with said sleeve.

8. The apparatus of claim 6 in which said wall of said neck portion is formed of a mesh material.

9. The apparatus of claim 6 in which said closure for said access opening in said wall of said body portion includes a first flap and an overlapping second flap, said closure including hook-fastening elements mounted on said first flap and loop-fastening elements mounted on said second flap.

10. The apparatus of claim 6 in which said closure for said access opening in said body portion is a zipper.

11. The apparatus of claim 6 in which said support comprises:

a first tab connected to a first section of said wall of said neck portion adjacent said open top of said hollow interior, said first tab having opposed ends, an inside surface which mounts hook-fastening elements and an outside surface which mounts loop-fastening elements;

a second strip having an inside surface connected to a second section of said wall of said neck portion opposite said first section, and an outside surface which mounts loop-fastening elements;

said neck portion being mounted to a pipe of the steam cleaning machine inserted with said open top of said hollow interior by attaching said hook elements on said inside surface at one end of said first tab to said loop elements carried on said outside surface of said second tab, and by attaching said hook elements on the inside surface of the other end of said first tab to said loop elements on the outside surface of said first tab.

12. The method of cleaning an item of jewelry, comprising:

mounting the neck portion of a cleaning device onto the steam pipe of a steam cleaning machine so that the nozzle at the end of the steam pipe extends into the hollow interior of the cleaning device formed by the neck portion and a body portion connected to the neck portion;

opening a closure located along an access opening formed in the body portion;

inserting an item of jewelry gripped by a holding tool through the access opening and into the hollow interior of the cleaning device in position proximate the nozzle of the steam cleaning machine;

closing the closure against the holding tool;

manipulating the item of jewelry within the hollow interior in the path of steam emitted from the nozzle of the steam cleaning machine; and opening the closure to remove the item of jewelry from the cleaning device.

* * * * *